US007708062B2

(12) United States Patent
Carro

(10) Patent No.: US 7,708,062 B2
(45) Date of Patent: May 4, 2010

(54) RETRIEVABLE DOWNHOLE PACKER ASSEMBLY

(76) Inventor: Gustavo Ignacio Carro, Av. Julio Salto Chacra 2 Ruta Chica y Ruta 22, (8324) Cipoletti - Provincia de Rio Negro - República Argentina (AR)

( * ) Notice: Subject to any disclaimer, the term of this patent is extended or adjusted under 35 U.S.C. 154(b) by 9 days.

(21) Appl. No.: 12/178,024

(22) Filed: Jul. 23, 2008

(65) Prior Publication Data

US 2009/0078407 A1 Mar. 26, 2009

(30) Foreign Application Priority Data

Sep. 25, 2007 (AR) ..... P20070104222

(51) Int. Cl.
*E21B 33/12* (2006.01)

(52) U.S. Cl. ..... 166/202; 166/141

(58) Field of Classification Search ..... 166/141, 166/202, 18, 387

See application file for complete search history.

(56) References Cited

U.S. PATENT DOCUMENTS

| | | | | |
|---|---|---|---|---|
| 2,606,618 | A * | 8/1952 | Page | 166/119 |
| 4,329,916 | A * | 5/1982 | Roeder | 92/240 |
| 4,921,046 | A * | 5/1990 | Caskey | 166/170 |
| 5,060,723 | A * | 10/1991 | Sutherland et al. | 166/202 |
| 5,226,492 | A * | 7/1993 | Solaeche et al. | 166/196 |
| 7,028,769 | B2 * | 4/2006 | Mullins | 166/177.3 |
| 7,225,870 | B2 * | 6/2007 | Pedersen et al. | 166/285 |
| 7,243,733 | B2 * | 7/2007 | McGuire et al. | 166/387 |

* cited by examiner

*Primary Examiner*—Daniel P Stephenson
(74) *Attorney, Agent, or Firm*—Gottlieb, Rackman & Reisman

(57) ABSTRACT

A retrievable packer assembly for use in operations into wellbores is provided. The packer assembly comprises a continuous mandrel with a valve body including seal cups to seal against an inner surface of a casing, and a gap defined between the valve body and the mandrel to permit or prevent circulation of fluid between the interior of the mandrel and a section of the casing above the seal cups in response to the movement of the valve body.

12 Claims, 5 Drawing Sheets

RETRIEVABLE DOWNHOLE PACKER ASSEMBLY

BACKGROUND OF THE INVENTION

1. Field of the Invention

This application claims priority from Argentinean Patent Application Ser. No. P 20070104222.

The present invention relates to a new retrievable packer assembly for use in wellbores and employed for several operations that are carried out in wellbores such as oil wells, water wells, gas wells, injection wells and the like. More particularly, the invention provides a packer system or assembly for sealing a section of a casing into a wellbore with automatic packing actuated by pressure, an incorporated circulation valve, seal cups and resilient expandable seal rings that allow the system to be employed in conventional tubing or casing as well as in coiled tubing, and together or only with a retrievable plug.

2. Description of the Prior Art

Retrievable packer tools are well known in the art for sealing one or more sections of a tubing, a casing or a wellbore to carry out wellbore operations such as stimulation works, either acid stimulation or fracturing, cementing operations, pressure tests, etc. Some of the conventional packers need to be rotated in order to be anchored into the tubing, therefore they can not be employed in coiled tubing.

While there are other systems that can be operated in coiled tubing the same are affected by several drawbacks. For example, there is a packer having seal cups, namely the "Straddle Packer", which must be assembled for a fixed predetermined length. This is a drawback because the length thereof must be shorter than the lubricator of the equipment in the continuous tubing.

This type of packing has two opposed sets of seal cups that allow for a hermetic sealing of the enclosed area. It is difficult to efficiently clean this kind of packer in case of undesired silting, as the fluids get enclosed between the two seal cups, thus hindering both washing and freeing and extracting operations.

Another type is the know pressure or tension packer working with an automatic anchorage system, usually referred to in the art as J-shaped guide or bracket or simply "J" for automatic cycling. This allows the jaw-drag-block bearing basket to fix against the casing or tubing by friction and by elevating the mandrel of the tool it is firmly attached to the cone. In this way, the tool is packed through pressure. The main disadvantage lies in the fact that the casing must be stressed in order to fix and pack the tool, thus imposing a limit to the tubing's capacity for resisting treatments pressure or putting the safety junctions in risk by traction. When the pressure and stress is applied inside the tubing the swelling will cause traction on the tool and tubing and consequently their operational lifespan is shortened by fatigue.

A third type of packer is the known seal cup Packer which comprises a piston-carrying sleeve support, and packing elements such as cups and plugs. The drawback of this model is that no fluids can be transported directly before treatment, as this tool's first reaction is to seal off by pressure differential caused by the direct contact between the seal cups and tubes. To make up for this disadvantage an additional valve has been added which entails the drawback of more threads and the deficiency of the valve when executing sand treatments, for hydraulic fractures, for example, because the sand stays in the valve blocking it, thus impeding future operations.

SUMMARY OF THE INVENTION

In view of the foregoing, it is an object of the invention to provide a new packer capable of solving all the previously mentioned problems, being a packer based on a novel combination of elements that in itself provides a novel result causing better fixation reliability, simple sealing, increased cleaning efficiency and operational automaticity.

It is even another object of the present invention to provide a new packer system that, as compared to retrievable packers with coiled tubing as the ones mentioned above, shows several excellent characteristics that meet all requirements and lack all drawbacks of similar products on the market. The inventive packer system includes an anchoring system comprising an upper pistons support that can be changed to hold the number of pistons required in view of the operation to be performed and the diameter of the tool, where the pistons are pushed towards and against the tubing or casing through differential pressure.

It is a further object of the invention to provide a packer system also comprising an integral mandrel allowing the tool to be cleaned at the end of the mandrel, an integral upper seal that guarantees hermeticity, a system of seal cups and plugs, that can be added or removed depending on the operation to be performed o the degree of security required. Sets of cups and rubber plugs can be added or removed to configure as a joint or stand-alone unit, with the packer optionally having an automatic "J" guide system that commands the hermetic position or circulation of the tool, while the "J" can be removed or replaced by a mechanical "J" that is operated by rotation, including a drag block to cause movement of the plug support assembly in relation to the piston support, the seal and the mandrel.

It is a further object of the invention to provide a retrievable downhole packer assembly for sealing against a section of a casing into a wellbore, with the packer assembly comprising an integral seal valve which can be entirely cleaned both through the annular space between the packer and the casing or directly through the packer. Another important advantage is the possibility to use the "J" to wedge or release the packing assembly, which in the case of an automatic vertical cycling "J", that does not require rotations to operate the tool with tubing, allows fluids to be circulated or moved directly through the packer without causing any undesired packing and with a new cycling of the tool, automatic packing is obtained as the packing assembly comes into contact with the seal and thanks to the natural hermetic character of the seal cups automatic packing is obtained.

It is another object of the invention to provide a retrievable downhole packer assembly that, thanks to the hydraulic nature thereof with no need of weights or tensions, the tool remains anchored to the tubing, leaving the tubing neutral, as weight or pressure are of no importance to realize pressure operations, alleviating the pressure of the tubing.

It is a further object of the invention to provide a retrievable downhole packer assembly that, when comparing to the three known types of retrievable packers previously mentioned, the inventive packer system shows the following advantages:

Referring to the "Straddle Packer", the packer of the invention has the advantage that it can be used as a plug and when used in tandem with this tool in the first place the desired length can be isolated. Secondly, thanks to the limited length when used jointly both tools can be fitted inside the hermetic lubricator. Another important advantage is the easy clearing and cleaning of the packer afterwards in case of premature or undesired silting, by simply cutting off pressure on the tubing and pumping through the annular space between the packer and casing so that the seal cups stop the clean fluid from flowing through the back of the packer and clean from the bottom directly towards the packer. This way the effective cleaning is achieved and the pistons return to their casings. The packer would then be ready for the next operation or to be transported.

With reference to the second packer type mentioned above, the packer of the invention shows the fundamental advantage that it needs no pressure nor weight to be fixed. In other words, it works hydraulically, through internal pressure and because the valve assembly is closed when the seal makes contact with the lip, the pistons are pushed out to the surface by differential pressure towards the tubing, anchoring themselves to the tubing. The more pressure is applied, the better positive wedging is achieved and better sealing, as the seal cups will close tighter thanks to the increased force. The major advantage of this lies in the fact that no pressure is needed to fix the tool. This makes it possible to leave the tool with a neutral weight and will not overcharge the tubing or casing during operations that require pressure, as the pressurized tubing will get shortened through swelling, increasing stress to the traction which is added to the stress already required to fix pressure tools. On the other hand, most continuous tubing systems have an emergency cut-off device, which in the case of the present packer would only be submitted to the stress caused by internal pressure and not the accumulated stress as in pressure tools.

With reference to the third type mentioned above the advantage of the present invention is its integral valve system, which allows fluids to flow through directly through the packer for the necessary transportation thereof. Furthermore, the geometric configuration and the positioning of the integral valve allows for a considerable transit of soiled or contaminated liquid which can be effectively cleaned afterwards and also facilitates posterior hermeticity.

It is a further object of the invention to provide a retrievable downhole packer assembly having an anchoring system in the form of an upper piston support including anchoring expandable pistons that can be replaced according to the type of casing they are to be anchored to, that is steel, glass fiber, etc. Different combinations can be used, e.g. hardened grooved pistons, with hard metal or tungsten inserts, etc. The piston support can also be configured to hold more or less pistons depending on the operation to be executed, the type of pressure or the diameter of the tool that is used. The function of the pistons is to grip or anchored tightly to the tubing or casing when an increase in differential pressure passes through the tubing. The present packer assembly contains an integral mandrel that allows for the washing of the tool, such as sand cleaning, straight circulation, reverse circulation, cement cleaning, etc. to be performed at the bottom. In case the Packer is used jointly with a retrievable plug, the mandrel allows for thorough cleaning of the tool as fluids can freely circulate through the fishing tool.

It is another object of the invention to provide a retrievable downhole packer assembly comprising an upper integral sealing valve that ensures hermeticity during fixing or extracting operations, permitting proper sealing when necessary for required pressure operations or to be opened for cleaning or when fluids need to be moved before a treatment. The packer of the invention also comprises a packing assembly consisting of seal cups and plugs which, thanks to the geometric shape of the cups, ensures conversion of pressure into packing force on the cup, rubber plugs and the seal of the integrated valve. These can be added or removed depending on the operation to be performed or the degree of security required. Packets of cups and plugs can be added or removed, as well as rubber plugs, and they can also be configured to act jointly or individually.

It is a further object of the invention to provide a retrievable downhole packer assembly including an automatic "J" guide that commands the hermeticity position or circulation of the tool, and the automatic "J" can be removed or replaced by a mechanical "J" operated by rotation. Depending on the type of operation, the "J" can be used to wedge or release the packing assembly. Consequently, when using an automatic vertical cycling "J", to operate the tool with continuous tubing no rotations are required. This way fluids can freely circulate and be moved directly through the packer without causing undesired packing and with a new cycling of the tool automatic packing is produced. This is caused by the fact that the packing assembly collides with the seal as a consequence of the natural hermeticity of the cups, which are in constant contact with the casing, and thus automatic packing is obtained. The inventive packer assembly also contains drag blocks to cause movement of the cup-plug support assembly relative to the piston support, seal and mandrel.

Therefore, the object of the current invention is to provide a retrievable packer with incorporated seal valve for wellbores, be it oil, water or gas wells, or any other similar fluid, that can be operated with coiled tubing and is used during stimulation works, such as hydraulic fractures, acids, etc., cementation, pressure tests, etc; it can be configured for many different operating conditions, such as coiled tubing, different diameters, different levels of security, different degrees of depth, etc. always with the goal of solving packing problems assured by the cup and plug assembly, that can operate jointly or independently or in series, wherein the differential pressure of the casing is transformed into packing force on the cup, rubber plugs and the seal of the integral valve (the more pressure, the better the packing), circulation problems (controlled by the "J" tool and the drag blocks), problems related to extraction and efficient cleaning of the tool (thanks to its integral mandrel) before and after the operations mentioned above, allowing fixation of the tubing, through the pistons that are located in the piston support, and hermeticity of the tool (thanks to its integral valve) through hydraulics (differential pressure) without need for pressure nor weight in the tubing, permitting, if required, leaving the tubing in a neutral state with regard to pressure.

Another goal of the invention is to provide a packer, packing system or retrievable packer to be used in wellbore operations using a tubing or casing, those wells being oil, water, gas wells or any other similar fluid, where the packer is of the kind that is used in temporary or permanent sealing of the well using seal cups who seal against the tubing or casing, and presenting the piston-supporting packer as a tool for fixation inside the tubing, where the packer consist of a continuous mandrel that comprises a valve body that in its turn is mounted with at least one set of the seal cups mentioned above. The valve body is axially downwardly mounted on the mandrel, in between a closing position against a seal in the mandrel and an opening position separated from said seal, maintaining a circulation passage for fluids between the valve body and the mandrel that can be closed off by switching the valve to its closing position.

It is therefore another object of the invention to provide a retrievable downhole packer assembly for sealing against a section of a casing into a wellbore, the packer assembly comprising:

a mandrel;

a valve assembly comprising a valve body and a valve seal, with the valve body being slidably and axially mounted in the mandrel to move into and out of sealing contact with the valve seal;

at least one seal cup mounted in a seal cup-carrying sleeve, and an annular gap defined between the valve body and the mandrel, wherein the valve body slidably moves along the mandrel between a closed position with the valve body in sealing contact with the valve seal to prevent any fluid flow through the annular gap, and an open position with the valve body out of sealing contact with the valve seal to permit any fluid flow through the annular gap.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Now referring in detail to the invention, the same refers to a packer or retrievable packer for isolating and sealing, temporarily or permanently, areas or sections of an oil well, etc, for carrying out several operations like stimulation, fracturing, acid injection, cementations, pressure tests, diverse treatments, etc.

The packer assembly comprises a piston support 1 at an upper end thereof, that can have an internal or external thread, wherein an upper gauge ring 2 is to be found, that can have the additional function of retaining security straps, otherwise a retainer ring for the straps can be placed, after which the upper gauge ring 2 is placed. Support 1 houses pistons 5 the function of which is to radially outwardly extend from the support 1 towards and against the casing or tubing by differential pressure, in order to anchor the tool to the casing, hence impeding its upward motion. The pistons support 1 can be configured to hold more or less pistons 5, depending on the conditions of the operations.

Figure 1A:
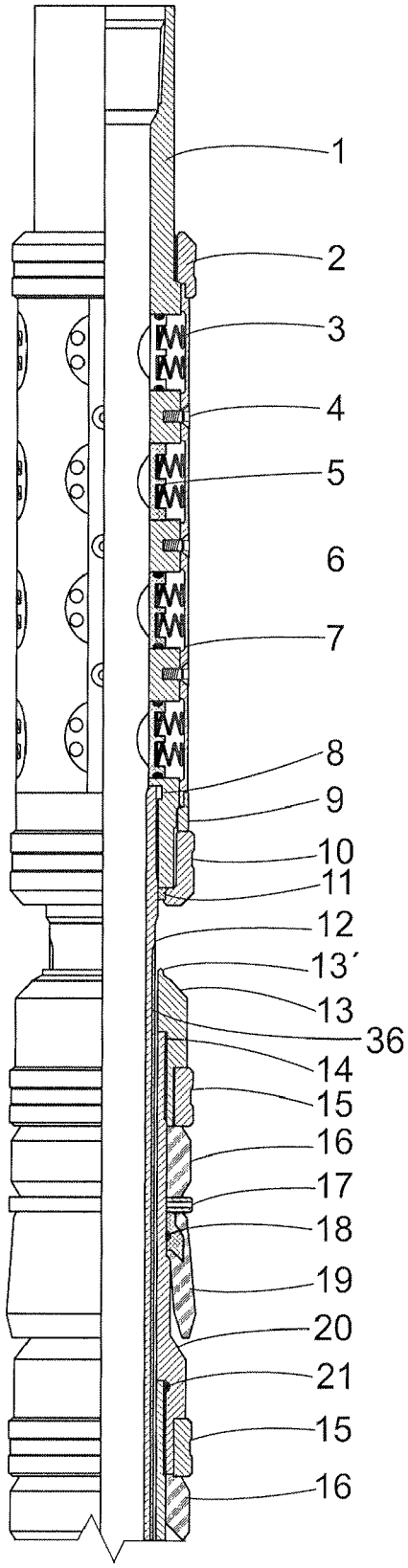
FIGS. 1A and 1B show a vertical cross section view of a packer assembly according to a preferred embodiment of the invention.
Figure 1B:
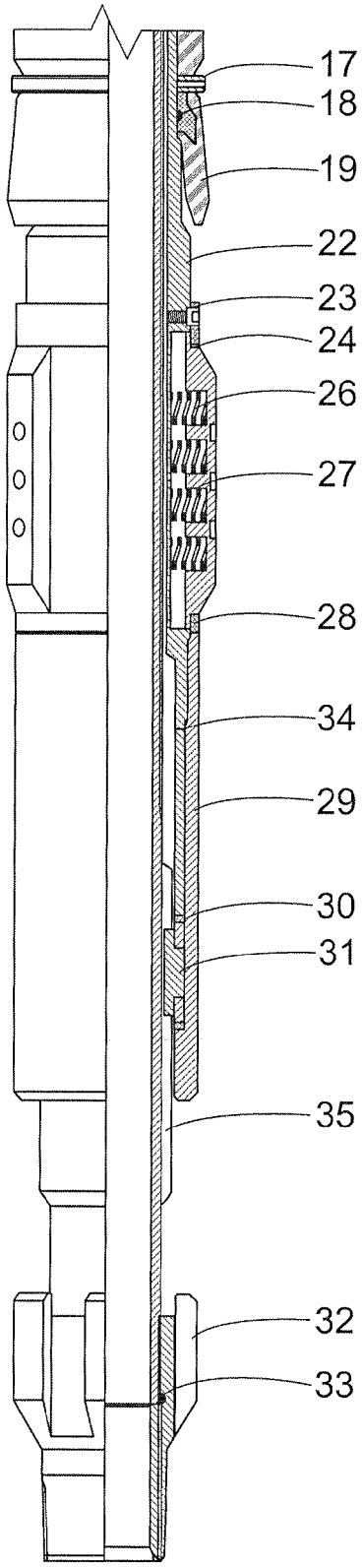
Figure 2:
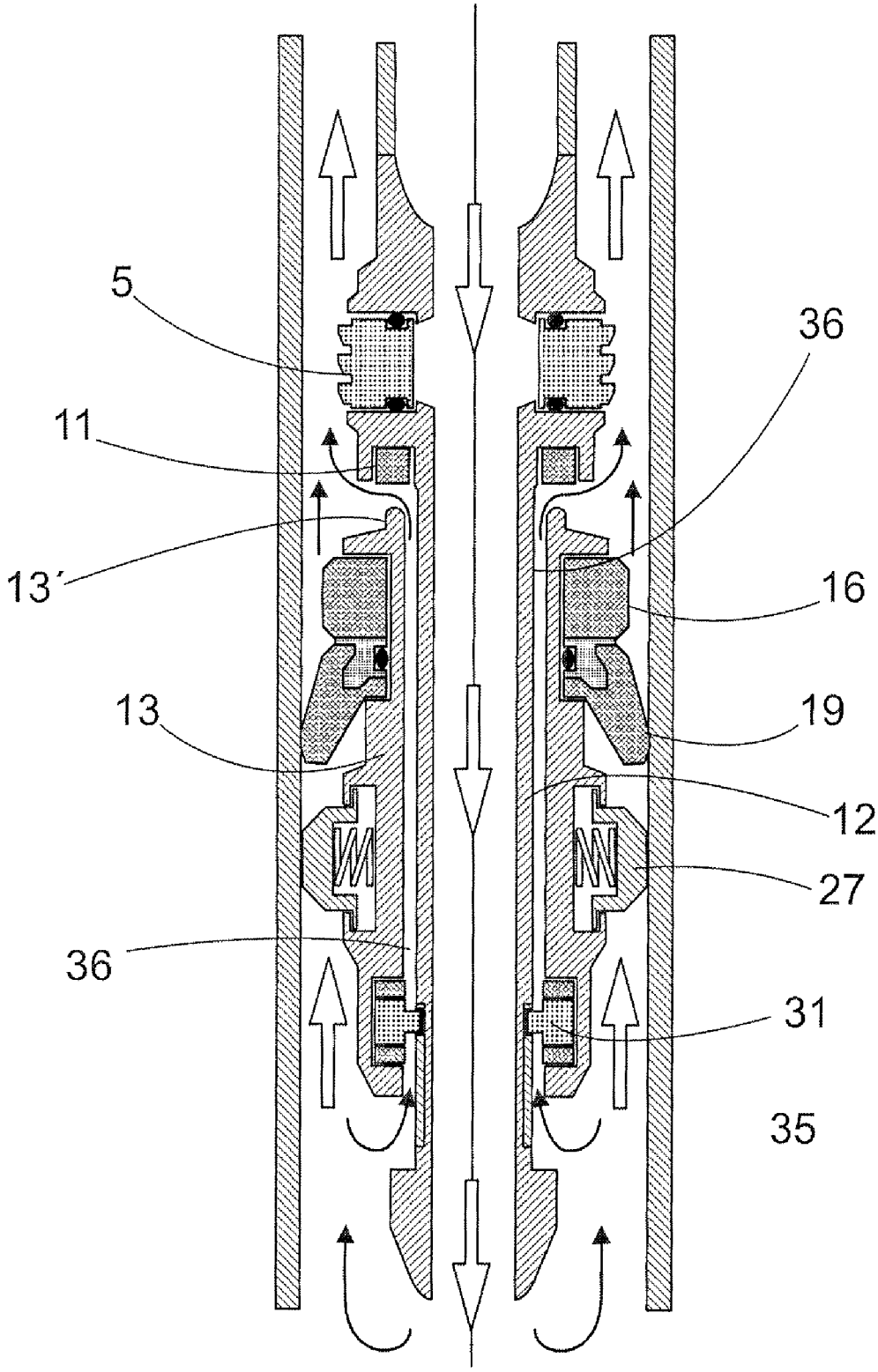
FIG. 2 schematically shows a cross-section view of the packer of FIG. 1 when the assembly is being lowered into the well bore and work fluid is injected into the packer assembly with the pressure inside the packer assembly and outside and above the packer assembly, being equalized through the gap formed between the valve body and the mandrel.
Figure 3:
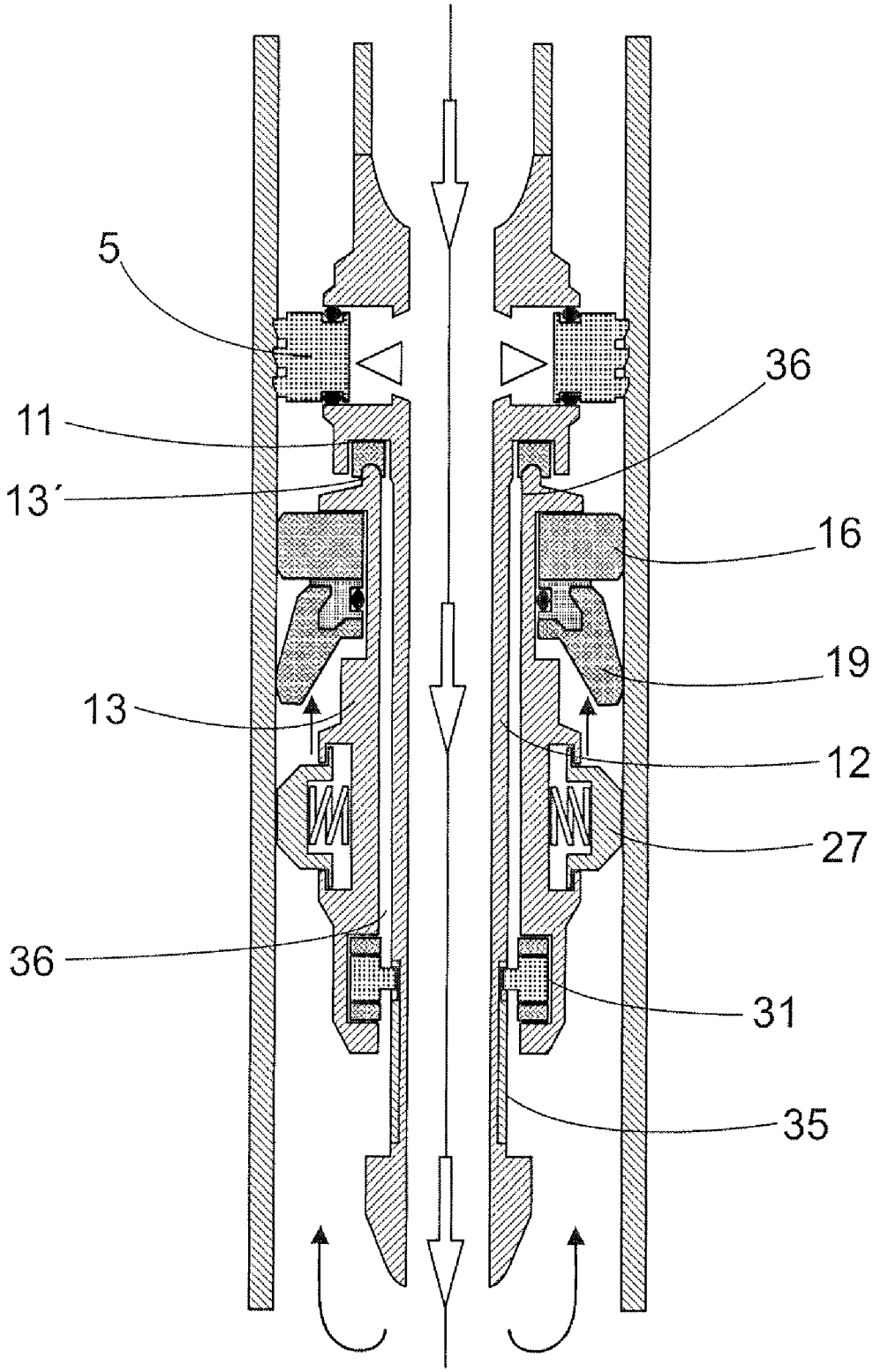
FIG. 3 schematically shows a cross-section view of the packer of FIG. 1 when the assembly is being anchored into a desired position within the well bore by the radial expansion of the pistons and the seal cups against the casing, with work fluid being injected into the packer assembly and the gap formed between the valve body and the mandrel being closed by the valve body sealing against the valve seal, and FIG. 4 schematically shows a cross-section view of the packer of FIG. 1 when the assembly is being washed by reversed fluid flow, with work fluid being injected through the annular space between the casing and the packer assembly and the gap formed between the valve body and the mandrel being open by the valve body placed spaced apart of the valve seal and the pistons and seal cups retracted.

Pistons 5 are sealed within the housing of support 1 with an O'ring 6, this way when internal pressure is applied they will extend outwards, towards the casing, see FIG. 3. When the packer experiences no differential pressure between the space inside the packer and the annular space between the packer and the casing pistons 5 are pushed and held inwards by piston springs 3, which rest on pistons 5 and strap 7, see FIGS. 2, 4. Strap 7 is attached at one extremity to a lower retainer ring 9 and at the upper part to upper gauge ring 2. In order to avoid buckling as a consequence of the force that the springs apply, both in active and passive state, some screws 4 are placed that press straps 4 to piston support 1. The number of pistons can vary according to the diameter of the tool, the condition of the well, the conditions of the operation and the like; of course it will be necessary to replace piston support 1. In the lower part of piston support 1 a seal bearing nut 10 is screwed, the function of which is to hold a seal 11 between seal bearing nut 10 and a mandrel 12 and the lower part of piston support 1. Seal bearing screw 10 can also fulfill the function of gauge ring, depending on its diameter. A lower spring retainer ring 9 is held between an end of piston support 1 and adjusted by using seal bearing screw 10.

Mandrel 12 is screwed to the lower part of piston support 1 and sealed by O'ring 8. On the lower part of mandrel 12 a "J" shaped slot arrangement 35 or "J" guide, or simply "J", is formed. This "J" can be formed for example by integral cutting or milling on the Mandrel 12, or the Mandrel 12 can be subdivided with threads, and the "J" can be inserted. This "J" can be configured by an "Automatic (indexed)" or "Mechanical" geometry, depending on the operation to be carried out. A lower head 32 is screwed to the lower part of mandrel 12, and sealed by the O'ring, that is fixed.

The packing assembly described below works onto mandrel 12 and it is placed in its working position by "J" 35 and activated by the friction between a drag block 27 and the casing. The packer assembly comprises a valve assembly comprising a valve body 13 and a valve seal 11, with an upper end of the valve body including a sealing lip 13' to seal against the valve seal. The valve body is slidably and axially mounted in mandrel 12 to be capable of moving into and out of sealing contact with valve seal 11. An annular gap 36 is also defined between valve body 13 and mandrel 12 to form a fluid flow passage to permit, when open, the fluid flow therethrough. Gap 36 will be open when valve body 13 is moved away from valve seal 11 and gap 36 will be closed with lip 13' of valve body 13 sealing against seal 11.

Independently of the force generated by the pressure between lip 13' and seal 11, the penetration against seal 11 is sufficiently controlled to guarantee sealing and is limited by the metal-to-metal contact between lip 13' and seal bearing nut 10. In other words, once the lip vertex makes contact with and penetrates seal 11. Then it makes metal-to-metal contact with valve body 13 and seal bearing nut 10, impeding excessive penetration of the lip which can cause seal 11 to tear. Screwed to valve body 13 and isolated by O'ring 14, which is located in valve body 13, a seal cup-carrying sleeve 20.

Sleeve 20 carries a packing assembly comprised of one or more seal cups 19 made of a resilient material, and further comprising a resilient expandable ring 16 axially mounted in seal cup-carrying sleeve 20, upwardly the at least one seal cup, and a separating ring 17 axially mounted in the seal cup-carrying sleeve, between the resilient expandable ring and the at least one seal cup, whereby the at least one seal cup may be outwardly radially expanded against the casing upon any fluid pressure coming from downhole, through the annular space between the packer and the casing, and the resilient expandable ring is radially outwardly expanded upon an upward pressure exerted by the at least one seal cup when expanded. Preferably, the at least one seal cup and the expandable ring are made of rubber and also preferably, the at least one seal cup comprises a plurality of axially arranged seal cups, with each seal cup associated with a separating ring and a resilient expandable ring.

The packing assemblies can be configured, varying in dimension and geometry of sleeve 20 and mandrel 12, in accordance with the requirements of the operation, and having the options of changing the amount of seal cups and plugs or expandable rings 16, using only cups, more rings or adding entire assemblies to increase security. In the case of the preferred embodiment, the packer is configured by two sets of cup seals and expandable rings. Cup 19 has a particular geometric configuration that allows it to retain pressure and pack in one only direction, in this case upwards, permitting the flow of fluids downwards, without any packing activity. Because cup 19 is vulcanized around an insert that contains O'ring 18, at the slightest difference in upward pressure, provided that valve body lip 13' is sealed to seal 11, and because cup 19 is sealed to sleeve 20 by the casing and O'ring 18, immediate packing is produced, as well as a translation of the pressure generated by force and movement that transmits compression through separating ring 17 and the plug or expandable ring 16, which is optional, in this way securing and guaranteeing the required hermeticity for the operations to be carried out. The configuration of hardness, diameters and geometries will change in accordance with the internal diameters of the casing. Gauge ring 15 is screwed to the lower part of valve body 13, used for the purpose of protection, centralization, etc. of the tool and its parts. Another gauge ring 15 is screwed to the lower part of sleeve 20.

Screwed to the lower part of sleeve 20 and isolated by O'ring 21 a drag block carrying sleeve or support 22 is provided. Another packing assembly is located here that works on this extension, corresponding to the same functional considerations as the ones described above. It is understood that packing assemblies can be added or removed, as many as required for an operation. We can remove the upper packing assembly, reducing the length of mandrel 12 and the packer will work in exactly the same way. Consequently, for operational security purposes, prudence, or operational conditions these configurations can be adapted. A drag block 27 can be provided in support 22, housed in grooves and sustained at the top side by a top block ring 24 and at the bottom side by a lower drag block ring 28. In order to generate friction against the casing, drag blocks 27 are forced by drag block springs 27. In other words, when the packer is introduced into the wellbore, drag blocks 27 will move into drag block sleeve 22 generating friction with the purpose of causing the relative movement of the casing and the tool (hermeticity mechanism), which in its turn is controlled by the "J", as is explained below. The top block ring 24 is wedged to support or sleeve 22 with screws 23, to prevent top block ring 24 and drag blocks 24 from coming out of the assembly, causing a problem inside the wellbore.

Screwed to the lower part of support 22 a pin carrying sleeve 29, also called merely "Pin" in the art, is provided. Inside pin carrying sleeve 29 from top to bottom an extension sleeve 34, a friction ring 30, a pin 31, or "pin" ring, and another friction ring 30 are also provided. Pin 31 can freely and easily rotate as it is supported by the upper and lower friction rings 30 whose main function is to decrease friction by rotation, when pin 31 should transit "J" shaped slot arrangement 35 which in this example is automatic or indexed. The function of extension sleeve 34 is to generate the required vertical location of pin 31 with reference to "J" 35 and mandrel 12, as well as to register the required tolerances to permit the free rotation of pin 31 but impeding its vertical movement.

Finally, lower head 32 is screwed to the lower part of mandrel 12, sealed by O'ring 33, whose function is to retain the packing assembly when the tool is removed from the wellbore.

Packer Operation:

The operation of the packer assembly of the present invention will be described below in connection with a preferred embodiment including an automatic "J" shaped slot arrangement or, as it is also known in the art, an automatic "J".

Once the packer has been screwed to the tubing the next step is to lower the tool down to the area where it will operate. At all times the drag blocks 27, locked by pin 31 in the "J" and dragging against the casing, forces the assembly upwards, either with the valve in the open position or in the closed position, that is the top of valve body 13 touching and sealing against seal 11. In this state it can be lowered in two different ways, either with the valve closed, for which it will be necessary to lower the tool with fluids circulating through the annular passage or space formed between the tool and the casing and returning through the tool tubing, or with the valve opened, as shown in FIG. 2, where forced circulation is not necessary as all the fluid in the annular space and forced downwardly by the cups will flow through annular gap 36 and the annular space between the packer assembly and the casing upwardly the seal cups.

More particularly, valve body 13, seal cup-carrying sleeve 20 and drag block carrying sleeve 22 are axially arranged and connected to each other and the annular gap is defined between an outer surface of mandrel 12 and the valve body, the seal cup-carrying sleeve and the drag block carrying sleeve. For clarity purposes, in the schemes of FIGS. 2-4, the three components, namely body 13, sleeve 20 and sleeve 22 are shown as only one member 13.

Once the desired depth is reached, if the valve is in closed position, as shown in FIG. 3, with lip 13' of valve body 13 making contact with seal 11 and thus producing hermeticity, simply applying pressure through the tool tubing, as shown by the Arrows indicating descending fluid flow inside mandrel 12, will be sufficient to cause the seal cups to produce immediate packing. Because cups 19 are in constant contact with the casing a low upward pressure is enough to start them packing against the casing. In this case the pressure will go all the way down through the interior of mandrel 12, as shown by the Arrows, applying upward pressure on cups 19, which in their turn will apply upward pressure on resilient expandable ring or plug 16, which will aid in sealing off the casing even more. The seal cup itself seals against the casing, however, as stated before, the configuration of the cups and plugs can be changed to transfer the force to valve body 13. This will cause lip 13' of valve body 13 to contact seal 11 with more force. As it has been explained above this force of the lip onto the seal is limited to protect seal 11 from tearing. In addition, to prevent the upward movement of the packer out of the well, pistons 5, under the effect of the internal pressure, will extend towards, and anchor against, the casing, thus preventing the entire packer from moving upwardly as a result of the pressure. In other words, the bigger the pressure inside the tool, the better the generated packing force will be as well as its sealing potential.

In the above circumstances pistons support 1, mandrel 12 and lower head 32 are attached to the casing by the pistons and the packing elements are packing and forcing valve body 13 and seal 11 to seal and remain sealed. It is worth noting that only one packing assembly (namely one seal cup) is needed, the bottom one in the drawing, as the second one at the top only fulfills a security function in case the bottom one fails. This is one of the advantages of this packer because it allows the user to configure it with as many extra assemblies as may be required.

If the valve is set to its opening position, see FIG. 2, which is another advantage of this tool, the packer allows fluids to flow directly through the tool before carrying the step of anchoring to close the valve, which sometimes is an essential requirement, and simple upwards or downwards movement, namely cycling, of the tubing will be enough, taking into account that, as the assembly is causing a relative movement by the resistance opposed by drag blocks 27 against the casing, this will cause movement and rotation of pin 31 by the "J" of mandrel 12. According to this embodiment, an automatic or indexed "J" is being used. If however, the packer is configured with a mechanical "J" vertical and rotational movements must be realized to unlock the "J" and consequently produce the hermeticity of the packer. In other words, as pin 31 moves upwards and downwards, it will travel the path or guide delimited by the geometry of the "J" slot arrangement and will change position, moving downwards again, pin 31 will be able to change to its sealing position allowing the assembly to place valve body 13 in sealing contact to seal 11.

In this position applying pressure through the tool tubing will be enough to have the cups produce immediate packing and for the above effects to take place.

In other words the pin moves into and along corresponding sections of the J-shaped slot arrangement 35 whereby the valve body and the pin carrying sleeve move together along the mandrel between said closed and open positions and can be selectively retained at said closed and open positions by the pin retained into said corresponding sections of the J-shaped slot. The slot arrangement may comprise a continuous slot or a plurality of slots.

In order to free the packer of the invention removing the pressure through the tool tubing is enough to cause pistons 5 return to their housings in the pistons support 1, pushed by springs 3 and the tool can be extracted from the well. Thanks to its design, the present packer assembly will allow fluids to circulate directly, inside the tool tubing, or underneath mandrel 12, which will allow for the efficient cleaning of the packer assembly both inside and out thereof, with the valve open or closed. This way, when it is lowered in tandem with a retrievable plug, for example, the tool and the wellbore can be washed from below without contaminating the mechanism.

Figure 4:
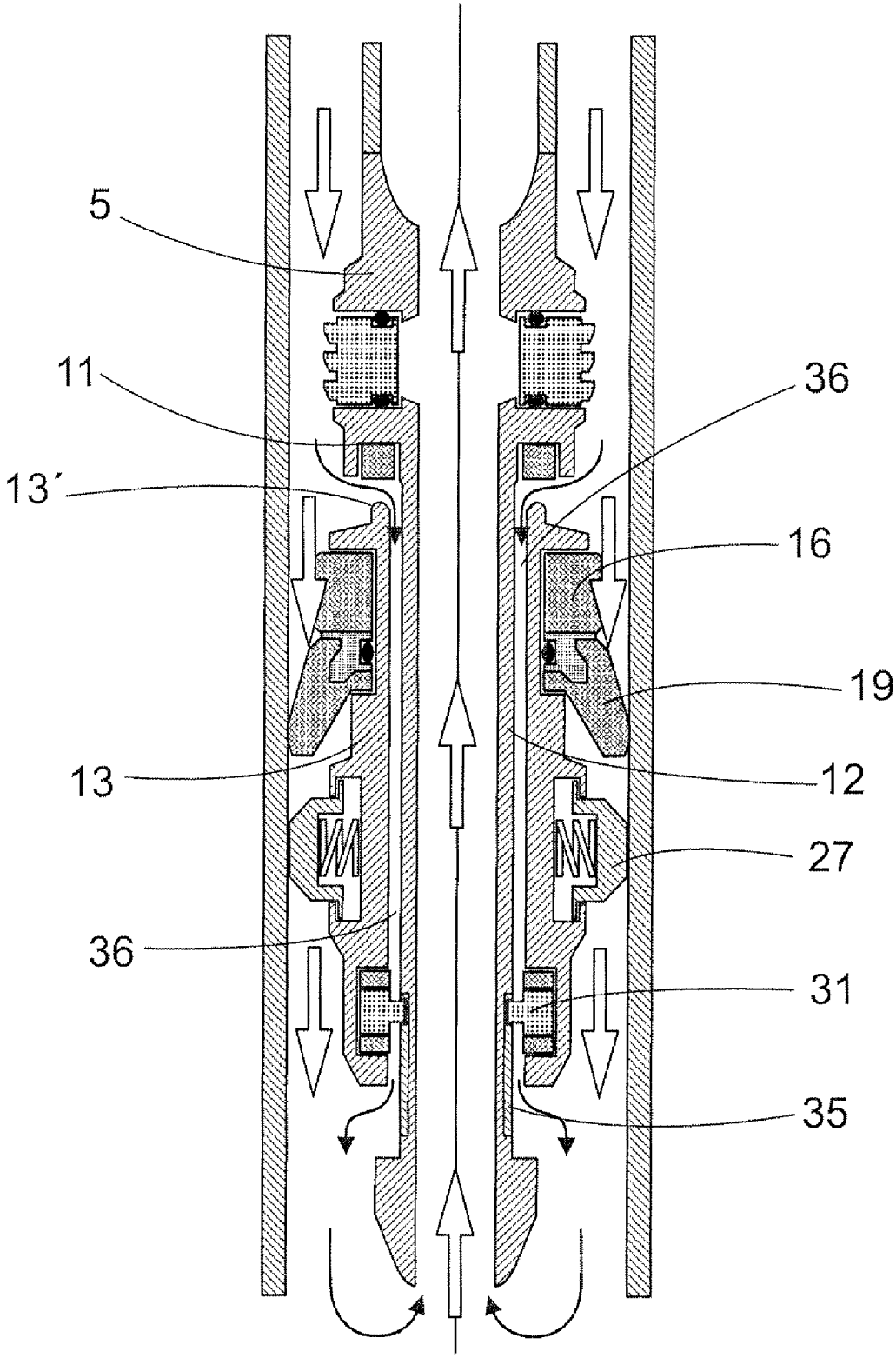

As shown in FIG. 4, with the valve assembly open, namely with lip 13' of valve body out of sealing from seal 11, the fluid injected through the space between the packer assembly and the casing, as shown by the going down arrows in FIG. 4, serves to wash the packer assembly inwardly and outwardly.

If other additional operations are required, it will only be necessary to make the depth changes of the packer assembly with their correspondent cycle changes, needed to carry out the required operations.

The packer assembly of the present invention has shown excellent efficiency and simplicity thanks to its particular design, with regards to the fixation mechanism and the integrity of its circulation valve, consequently no pressure is needed to fix the casing in the desired position. Therefore it is an ideal tool to be used in the operations mentioned above, it is a versatile tool that can be used with conventional tubing or coiled tool tubing.

During pressure operations, being tests, stimulation works or cementation operations, the fluids inside the tool tubing before treatment need to be moved, so that they are not injected in the formation. The present invention has a mechanism for this automatic cycling which is operated without the need for rotations on the string of the tubing. This is why it is an ideal tool to be used with coiled tubing. This cycling mechanism through vertical movement allows the valve to be wedged in open position, this way leaving the option to move the fluid directly through the tool tubing towards the annular passage and then with a simple vertical cycling movement it is closed to allow hermeticity and packing so the packer can perform its task in the well.

Because of its constructive and operational characteristics the mandrel of the tool is integral thus permitting, when circulation is required to clean from the well bore annular passage directly towards the inner bore of the tool tubing, to do so without problems and allow circulation under the tool. This way sand and dirt are efficiently cleaned and treatment fluids are reversed. This is a very important characteristic as the packing elements, namely the seal cups, allow inverse circulation by pressure without any problem, in case the valve is in closed position.

In case the treatments or pressure tests use coiled tubing it is extremely important not to expose the tubing to more pressure than is already being applied during treatments. For that reason this invention shows additional advantages to operate with coiled tubing, as automatic packing occurs thanks to the valve configuration and the use of seal cups and rubber rings or plugs, once packing has been produced by internal pressure, the tool uses the pistons housed in the pistons support which anchor themselves to the casing by internal pressure, preventing the tool from lifting itself up. Consequently the tubing can be left in any desired state, with weight, neutral or under pressure.

In case of premature silting which is undesired for the stimulation works by formation fracture, the tool of the invention allows for the fluid with sand to be reversed from the annular space between the tool and the casing directly to the packer without problems as the tool needs neither pressure nor weight to anchor. In other words, reversing behind the cups is possible when required.

Because of its compatibility the tool of this invention can be lowered and operated in tandem with an automatic cup plug system in case this is required when using coiled tubing, or it can be lowered and operated with a rotation plug when using conventional tubing.

Therefore the present packer is the ideal tool for all the operations mentioned above, especially those that are deviced with coiled tubing, as the tool has been specifically designed to be operated with no need for rotations and guaranteeing automatic hermeticity whereby no additional pressure is applied to the tool tubing other than the pressure which is the proper for the operations.

While the present description refers to the present packer system as being used with coiled tubing, in view of its virtues it can be used without any problem with conventional screwed tubing. In this way it can be lowered and operated in tandem with automatic seal cup plugs, conventional in weight and rotation, etc.

While preferred embodiments of the present invention have been illustrated and described, it will be obvious to those skilled in the art that various changes and modifications may be made therein without departing from the scope of the invention as defined in the appended claims.

I claim:

1. A retrievable downhole packer assembly for sealing against a section of a casing into a wellbore, the packer assembly comprising:

a mandrel;

a valve assembly comprising a valve body and a valve seal, with the valve body being slidably and axially mounted in the mandrel to move into and out of sealing contact with the valve seal;

at least one seal cup mounted in a seal cup-carrying sleeve, an annular gap defined between the valve body and the mandrel, a piston support connected to an upper end of the mandrel, the piston support carrying a plurality of pistons capable of radially extending against the casing to anchor the mandrel into a position within the casing, and a seal retaining nut that retains the valve seal against the mandrel and the piston support, wherein the valve body slidably moves along the mandrel between a closed position with the valve body in sealing contact with the valve seal to prevent any fluid flow through the annular gap, and an open position with the valve body out of sealing contact with the valve seal to permit any fluid flow through the annular gap.

2. The assembly of claim 1, wherein an upper end of the valve body includes a sealing lip to seal against the valve seal, wherein the upper end of the valve body being designed to make contact against the seal retaining nut to protect the valve seal against excessive sealing pressure from the sealing lip at the closed position of the valve body.

3. The assembly of claim 2, wherein the piston support is a tubular support with a central bore for circulation of fluid and a housing for said plurality of pistons, with the housing being open to the central bore in a manner that any pressurized fluid circulating through the central bore exerts pressure against the pistons to urge the pistons radially outwardly from the piston support.

4. The assembly of claim 2, wherein the at least one seal cup is made of a resilient material, the assembly further comprising a resilient expandable ring axially mounted in the seal cup-carrying sleeve, upwardly the at least one seal cup, and a separating ring axially mounted in the seal cup-carrying sleeve, between the resilient expandable ring and the at least one seal cup, whereby the at least one seal cup may be outwardly radially expanded against the casing upon any fluid pressure coming from downhole and the resilient expandable ring is radially outwardly expanded upon an upward pressure exerted by the at least one seal cup when expanded.

5. The assembly of claim 4, wherein the at least one seal cup and the expandable ring are made of rubber.

6. The assembly of claim 5, wherein the at least one seal cup comprises a plurality of axially arranged seal cups, with each seal cup associated with a separating ring and a resilient expandable ring.

7. The assembly of claim 2, further comprising at least one drag block in a drag block carrying sleeve arranged axially downwardly the at least one seal cup, the drag block exerting a radial outward resilient force against the casing during moving of the packer assembly along the casing.

8. The assembly of claim 7, further comprising guide means comprising a J-shaped slot arrangement in said mandrel and a pin guided into said slot arrangement, the pin being mounted in a pin carrying sleeve.

9. The assembly of claim 8, wherein the pin carrying sleeve is connected to the valve body, whereby the valve body and the pin carrying sleeve move along the mandrel between said closed and open positions and can be selectively retained at said closed and open positions by the pin into corresponding sections of the J-shaped slot arrangement.

10. The assembly of claim 9, wherein the J-shaped slot arrangement is an automatic J-shaped slot arrangement.

11. The assembly of claim 9, wherein the J-shaped slot arrangement is a mechanic J-shaped slot arrangement.

12. The assembly of claim 7, wherein the valve body, the seal cup-carrying sleeve and the drag block carrying sleeve are axially arranged and the gap is defined between an outer surface of the mandrel and the valve body, the seal cup-carrying sleeve and the drag block carrying sleeve.

* * * * *